US007861652B2

(12) United States Patent
Metrope

(10) Patent No.: US 7,861,652 B2
(45) Date of Patent: Jan. 4, 2011

(54) PACKING SLEEVE FOR A PRINTING UNIT CYLINDER OF AN OFFSET PRINTING PRESS

(75) Inventor: Jacques Metrope, Laigneville (FR)

(73) Assignee: Goss International Montataire SA, Montataire (FR)

( * ) Notice: Subject to any disclaimer, the term of this patent is extended or adjusted under 35 U.S.C. 154(b) by 831 days.

(21) Appl. No.: 10/594,643

(22) PCT Filed: Mar. 25, 2005

(86) PCT No.: PCT/IB2005/000776

§ 371 (c)(1),
(2), (4) Date: Jun. 25, 2007

(87) PCT Pub. No.: WO2005/092618

PCT Pub. Date: Oct. 6, 2005

(65) Prior Publication Data

US 2008/0041254 A1 Feb. 21, 2008

(30) Foreign Application Priority Data

Mar. 29, 2004 (DE) ..... 10 2004 015 248

(51) Int. Cl.
*B41F 27/10* (2006.01)

(52) U.S. Cl. ..... 101/375; 101/376; 101/217; 101/216

(58) Field of Classification Search ..... 101/216–219, 101/375–376, 382.1, 389.1, 401.1
See application file for complete search history.

(56) References Cited

U.S. PATENT DOCUMENTS

| | | | | |
|---|---|---|---|---|
| 3,820,460 | A | 6/1974 | McElreath | |
| 5,797,322 | A * | 8/1998 | Lorig et al. | 101/375 |
| 5,813,336 | A | 9/1998 | Guaraldi et al. | |
| 6,823,787 | B1 * | 11/2004 | Saueressig | 101/376 |
| 2006/0021534 | A1 * | 2/2006 | Beaudry | 101/389.1 |
| 2008/0038493 | A1 * | 2/2008 | Chrigui | 428/34.1 |

FOREIGN PATENT DOCUMENTS

| | | |
|---|---|---|
| DE | 19918432 | 10/2000 |
| DE | 19918432 A1 * | 10/2000 |
| EP | 1375145 | 1/2004 |

* cited by examiner

*Primary Examiner*—Judy Nguyen
*Assistant Examiner*—Shema T Freeman
(74) *Attorney, Agent, or Firm*—Davidson, Davidson & Kappel, LLC

(57) ABSTRACT

A packing sleeve including an outer lateral surface for a printing unit cylinder of an offset printing press is disclosed, wherein the outer lateral surface has at least one region with an area containing a number of incisions, which increase the elasticity of the packing sleeve in the peripheral direction. The packing sleeve according to the invention can advantageously be used to enlarge the effective outer diameter of a printing unit cylinder in an offset printing press by drawing the packing sleeve over the printing unit cylinder in the offset printing press.

16 Claims, 3 Drawing Sheets

PACKING SLEEVE FOR A PRINTING UNIT CYLINDER OF AN OFFSET PRINTING PRESS

BACKGROUND

The invention relates to a packing sleeve having an outer lateral surface for a printing unit cylinder of an offset printing press.

In a printing press, the circumferential length of the printing plate cylinder is a basically limiting parameter for the format or the printing length of products to be produced. In order to achieve flexibility and variability, it is desirable to overcome this limitation to permit a variation in print length or a variation in format. For general geometrical reasons, it is known that the circumferential length of a cylinder, here the printing plate cylinder or rather the transfer cylinder, is proportional to its radius. To vary the circumferential length of a fixed-radius cylinder in a printing press, on which cylinder a printing plate is receivable, sleeve-form packings (packing sleeves) of different thickness can advantageously be mounted on the cylinder. Such sleeves can in specific constructions be seamless or slit. In other words, packing sleeves can be closed tubes or bodies comprising plate-form objects, which have been bent so that remote extreme edges lie opposite one another. With the sleeve mounted, and with a consequently larger radius, the potential or maximum achievable print length is then greater or longer than without the mounted sleeve. The circumferential length of a transfer cylinder or rubber blanket cylinder needed for an offset printing process can also be varied correspondingly. An enlargement of the effective outer diameter of the cylinder, that is, the circumferential length effective in printing mode, can therefore be achieved.

It is known, for example, from the document U.S. Pat. No. 5,813,336, to mount sleeve-form saddles on printing unit cylinders in a printing press, especially printing plate cylinders and transfer cylinders. Plate-form printing plates can be fixed to sleeve-form saddles. In their outer lateral surface the described sleeve-form saddles have an opening that runs substantially parallel to the figure axis, especially the axis of rotational symmetry of the saddle. The leading edge and trailing edges of a printing plate to be received can be inserted in the opening and be fixed with a printing plate fixing means, not specified in detail. Sleeve-form saddles are provided in different thicknesses (having different outer diameters).

Such packing sleeves have to have a good dimensional stability, for example, they must be able to withstand a compression as a result of cylinders rolling on one another, that is, a force acting in the radial direction. On the other hand, they must be resilient in the peripheral direction (circumferential direction), if a printing plate or a rubber blanket to be received on the outer lateral surface is to be tensioned. At the same time, the surface regions that absorb the tension forces should withstand the pressure generated, so that a comparatively rigid, stiff or low-resilience material is preferred for this in order to avoid wear.

SUMMARY OF THE INVENTION

An object of the present invention is to produce a packing sleeve having anisotropic elasticity properties.

The present invention provides a packing sleeve, preferably of a metallic material, for a printing unit cylinder of an offset printing press, preferably a printing plate cylinder or a rubber blanket cylinder, including an outer lateral surface having at least one region with an area containing a number of incisions, slits, gaps or elongate openings, which increase the elasticity of the packing sleeve in the peripheral direction. In other words, the number of incisions reduces the dimensional stability in the peripheral direction or circumferential direction. A resilient deformation of the packing sleeve in the peripheral direction may become possible. In particular, the incisions may have a small width in relation to their length; the incisions may have an orientation. In particular, each web in the area containing the incisions may have a small width, a small average area or a small thickness and may be deformable. Very fine incisions may be produced, for example, by means of a laser beam, preferably a carbon dioxide laser, for example.

The present invention further provides a method for a packing sleeve, preferably a slit packing sleeve, which has the desired resilient properties for an intermediate sleeve varying the circumferential length of a printing unit cylinder, whilst at the same time an actually relatively stiff or rigid material can be used. In particular, the material itself may have isotropic elasticity properties. It is clear to the expert that the thickness, gauge, or the outer diameter of the packing sleeve according to the invention may remain substantially unchanged upon elongation or strain in the peripheral direction. The packing sleeve according to the invention in this way may provide a resilient recovery force in the circumferential direction, corresponding to the force of a linear spring.

The present invention may be applied to packing sleeves of any convenient material, for example, plastics materials or composite materials. The packing sleeve may preferably consist of steel or aluminium. The packing sleeve may also be called an intermediate sleeve or a saddle: if the printing unit cylinder is a printing plate cylinder, a printing plate may be received on the packing sleeve, and if the printing unit cylinder is a blanket cylinder, a printing blanket or rubber blanket may be received on the packing sleeve.

In a preferred embodiment, the incisions contained in the area may run on the outer lateral surface of the packing sleeve substantially parallel to the figure axis of the packing sleeve, preferably to the axis of rotational symmetry of the packing sleeve. In addition, or as an alternative, the incisions in the area may be arranged along lines, incisions of adjacent lines lying offset, preferably regularly offset, with respect to one another. In other words, the area may have a pattern, preferably a regular pattern of incisions. Depending on the shaping of the incisions and the ratio of the volume of the material webs around the incisions to the volume of the incisions, the area with a number of incisions may also be referred to as a netlike or honeycomb structure. This area may have a macroscopic structuring in material webs and incisions. Preferably, the ratio of the length of the incisions to the spacing of adjacent lines may amount here to a number between 5.00 and 50.00, preferably a number between 12.00 and 25.00, for example.

The dilatation, elongation or deformation may be dependent on the number of incisions, preferably lines along which the incisions are arranged: the larger this number is, the weaker the deformation of each individual incision is.

In a preferred embodiment, a packing sleeve according to the invention may include a number of segments that are welded together alternately discontinuously. For example, for a packing sleeve welded together from 21 individual segments, for an elongation of around 0.4 mm, each incision, here the un-welded gap, will have a width of 0.02 mm.

In other preferred embodiments of the packing sleeve according to the invention, the region may extend substantially over the entire outer lateral surface. Furthermore, it may be advantageous if the width of the incisions is sufficiently small that a printing plate to be received on the packing sleeve according to the invention is not deformed by the incisions during printing mode.

In a further development, the packing sleeve according to the invention may have a slot or an opening in the outer lateral surface for receiving edges of a plate-form printing plate or of a printing blanket. Such a slot or such a opening may be in particular trapezoidal or prismatic, a widening being effected from the outer lateral surface towards the inner lateral surface. The slot may be continuous, that is, it can cut through the packing sleeve from the outer lateral surface to the inner lateral surface. In particular, in an advantageous embodiment, in an area surrounding the slot, wherein the surrounding area may be small compared with the overall outer lateral surface of the packing sleeve, the packing sleeve may have no incisions.

The invention also provides a method for the packing sleeve, as depicted in this description generally and in various embodiments and developments, for enlarging the effective outer diameter of a printing unit cylinder, preferably a printing plate cylinder or a rubber blanket cylinder in an offset printing press, preferably a web-fed rotary offset printing press, by drawing the packing sleeve over the printing plate cylinder in the offset printing press.

BRIEF DESCRIPTION OF THE DRAWINGS

Further advantages and advantageous embodiments and developments of the invention are explained with reference to the following Figures and the description thereof. In the Figures.

DETAILED DESCRIPTION OF THE PREFERRED EMBODIMENTS

Figure 1:
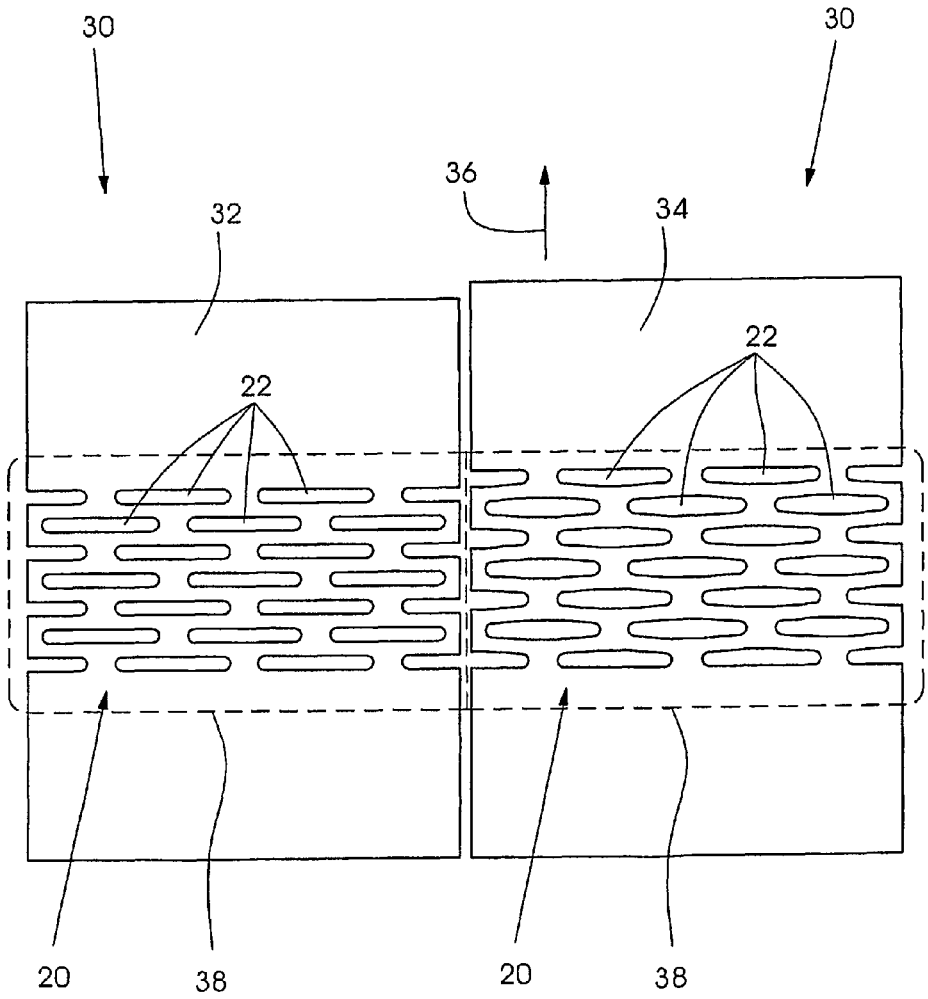
FIG. 1 shows two states of a plate-form object that can be shaped to form a packing sleeve according to the invention.
Figure 2:
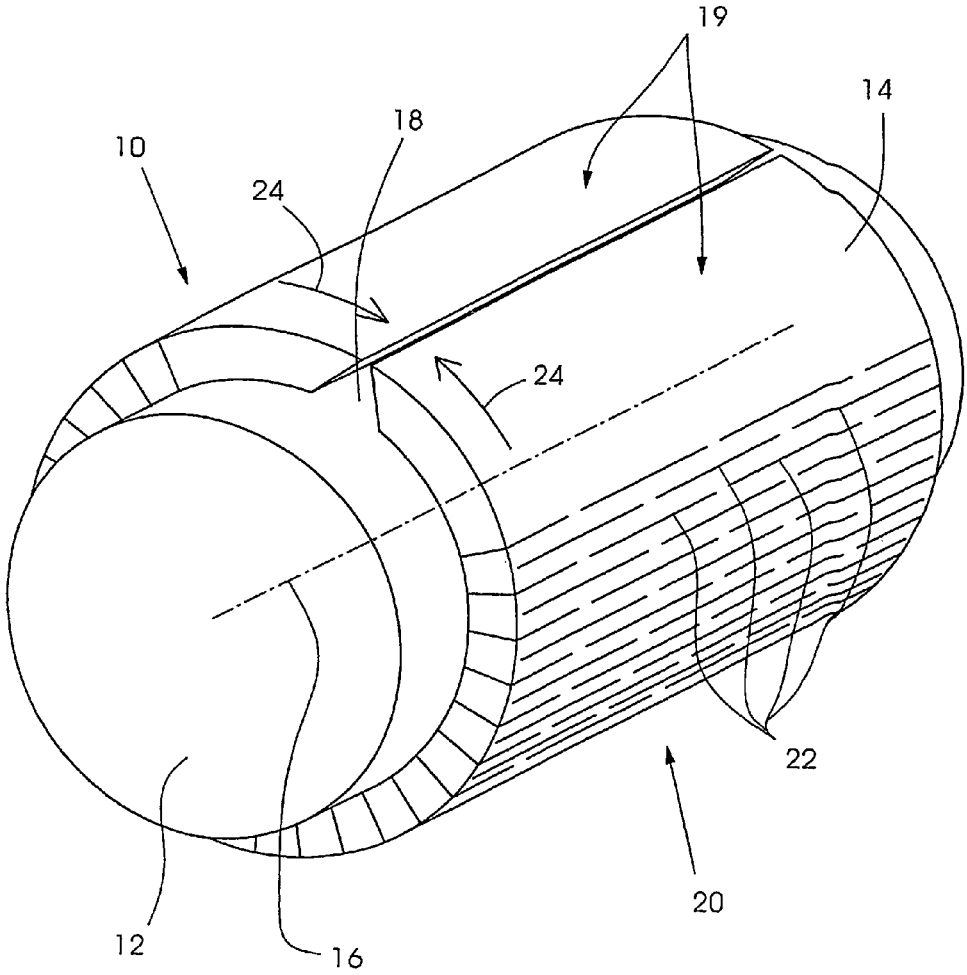
FIG. 2 shows an embodiment of a packing sleeve according to the invention on a printing unit cylinder.
Figure 3:
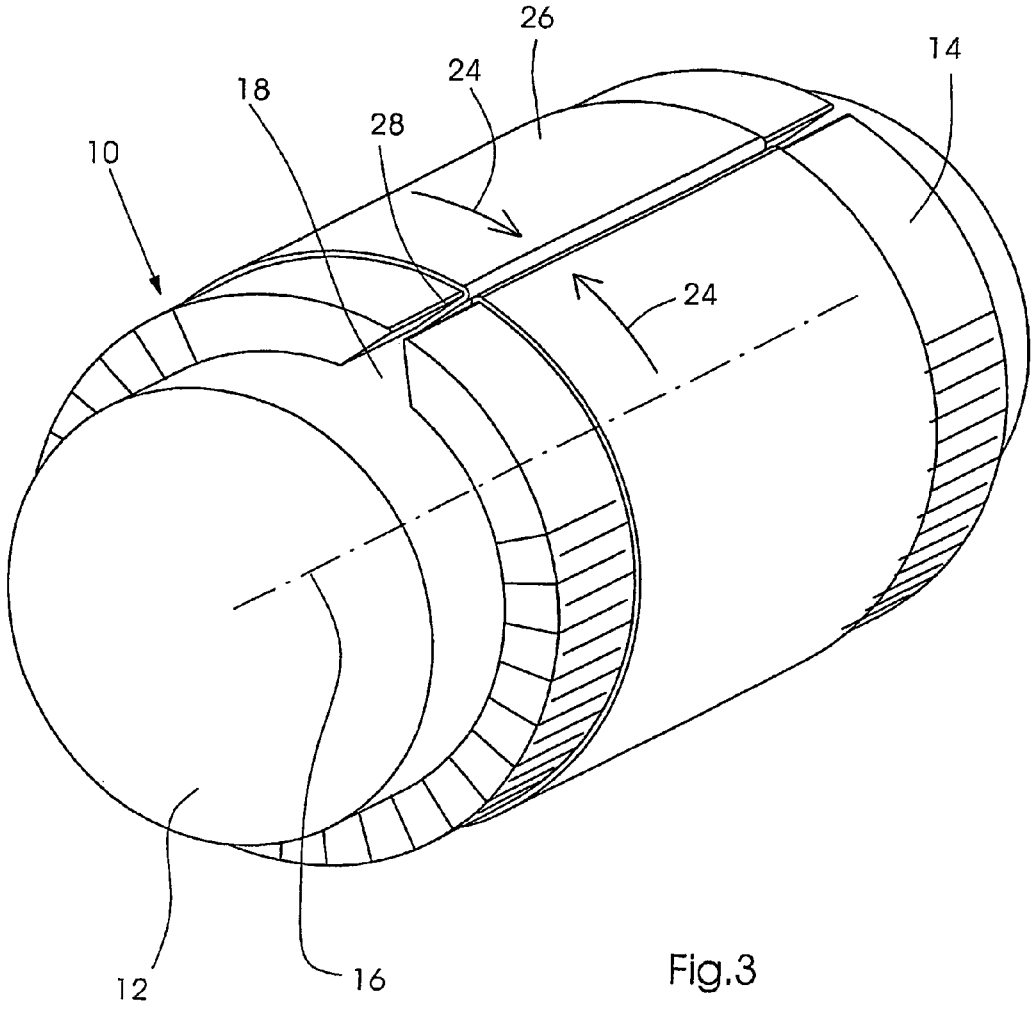
FIG. 3 shows an embodiment of a packing sleeve according to the invention that receives a cylinder packing.

FIG. 1 shows two states of a plate-form object 30, preferably of steel or aluminium, which can be shaped to form a packing sleeve 10 according to the invention (see FIGS. 2 and 3). The plate-form object 30 includes a region 38 with an area 20 of incisions 22. The incisions 22 can be apertures or cut-outs. Preferably, these incisions 22 are continuous, that is to say, the incisions 22 cut through the plate-form object 30, preferably in the form of slots or elongated slits. The incisions 22 are arranged along lines, incisions on adjacent lines being arranged offset or alternating with respect to one another. The left-hand side of FIG. 1 shows the plate-form object 30 in the resting state 32 or force-free state. In this situation, the plate-form object 30 has a specific dimension and a specific resilient behaviour, which are contingent upon its form and its material. The right-hand side of FIG. 1 shows the plate-form object 30 in a second state 34, in which a force 36, a tensile force, acts on the plate-form object 30 with a force component perpendicular to the run of the incisions 22. By virtue of the incisions 22 in the area 20, which have an orientation and hence an anisotropy owing to their shaping, the resilient behaviour of the plate-form object 30 changes, preferably anistropically, compared with an object of corresponding form without incisions. Perpendicular to the run of the incisions 22, a force 36 causes a dilatation of the plate-form object 30. This deformation or elongation is resilient; on cessation of the force effect, the plate-form object 30 reverts to its resting state 32, as shown on the left-hand side of FIG. 1. To cite an example: a packing sleeve according to the invention of 35 mm thick steel, in which alternating incisions of a length of 200 mm are arranged in twenty lines spaced 10 mm apart, can be extended by 0.4 mm with 35 daN per metre of the packing sleeve width (in the direction of the figure axis).

FIG. 2 shows an embodiment of a packing sleeve 10 according to the invention on a printing unit cylinder 12. Without loss of generality in respect of the topology and the geometry of a packing sleeve according to the invention, the embodiment shown here is a packing sleeve having slits passing right through it. The packing sleeve 10 has an outer lateral surface 14 and has a figure axis 16, which in the mounted state coincides with the axis of rotation of the printing unit cylinder 12. On the outer lateral surface 14 there is an area 20 containing a number of incisions 22. The incisions 22 are arranged along lines substantially parallel to the figure axis 16. Adjacent lines in the circumferential direction have alternating incisions 22, so that a netlike structure of webs between the incisions 22 is created. The packing sleeve 10 can be tensioned in the peripheral direction 24. A slot 18 serves to receive edges of a cylinder packing (see FIG. 3). In the area 19 surrounding the slot 18 the packing sleeve has no incisions 22.

For the sake of completeness, it should be mentioned that to change the fixing state of the packing sleeve, preferably for mounting or demounting, the printing unit cylinder of this embodiment has a device for tensioning the packing sleeve in the peripheral direction, the device not being more specifically shown here although it is known from the prior art. In the relaxed state, the packing sleeve can be moved relatively easily relative to the printing unit cylinder. As an alternative to this solution, changing of the fixing state, that is, mounting and demounting of the packing sleeve, can be facilitated by stretching the packing sleeve, preferably an embodiment of the packing sleeve having an area of incisions that do not cut completely through the packing sleeve from the outer to the inner lateral surface, by means of compressed air issuing from the printing unit cylinder, so that the packing sleeve is readily displaceable relative to the printing unit cylinder. Such devices are also known from the prior art.

As already mentioned, the packing sleeve according to the invention may be manufactured from a lightweight material, for example aluminium, so that manipulation thereof is simplified. Furthermore, recesses may be present, preferably on the inner lateral surface of the packing sleeve, so that the weight of the packing sleeve is reduced, without altering the stiffness.

FIG. 3 is a schematic view relating to an embodiment of a packing sleeve 10 according to the invention which receives a cylinder packing 26, for example, a printing plate or a printing blanket (rubber blanket). The cylinder packing 26 is held by clamping and stretching the packing sleeve 10 in the peripheral direction 24. The cylinder packing 26 has bent-over edges 28, which engage in the slot 18. The slot 18 widens prism-form from the outer lateral surface 14 inwards towards the figure axis 16. The lateral faces of the slot are thus undercut or angled; the lateral faces and the outer lateral surface enclose an acute angle, so that when a force is effective in the peripheral direction 24, the cylinder packing 26 is stretched in the circumferential direction.

In summary it should again be emphasised that the packing sleeve according to the invention, in particular a metallic packing sleeve, preferably advantageously may have a resilience adapted in the circumferential direction to the tension forces, whilst the regions of the outer lateral surface that are subjected to load transmission and to wear and tear experience no weakening or reduction in rigidity by virtue of the hardness and the stiffness of the material used, in particular the metal used.

LIST OF REFERENCE NUMERALS

10 Packing sleeve
12 Printing unit cylinder
14 Outer lateral surface
16 Figure axis
18 Slot
20 Area
22 Incision
24 Peripheral direction
26 Cylinder packing
28 Edge
30 Plate-form object
32 Resting state
34 Second state
36 Force
38 Region

The invention claimed is:

1. A packing sleeve for a printing unit cylinder of an offset printing press comprising:

an outer lateral surface having at least one region and a slot; and an inner lateral surface, the slot being continuous and extending from the outer lateral surface to the inner lateral surface, the slot receiving edges of a plate-form printing plate or a printing blanket;

the at least one region including an area having a plurality of incisions;

the plurality of incisions increasing an elasticity of the packing sleeve in a peripheral direction;

wherein the incisions run parallel to an axis of the packing sleeve.

2. The packing sleeve as recited in claim 1 wherein the incisions in the area are arranged along lines, the incisions of adjacent lines lying offset with respect to one another.

3. The packing sleeve as recited in claim 2 wherein a ratio of a length of the incisions to a spacing of adjacent lines is between 5.00:1 and 50.00:1.

4. The packing sleeve as recited in claim 1 wherein the region extends over the entire outer lateral surface.

5. The packing sleeve as recited in claim 1 wherein a width of the incisions is selected to reduce deformation during a printing mode of a printing plate received on the packing sleeve.

6. The packing sleeve as recited in claim 1 wherein an area surrounding the slot has no incisions.

7. The packing sleeve as recited in claim 1 wherein the packing sleeve is steel or aluminum.

8. A method for enlarging the effective outer diameter of a printing unit cylinder in an offset printing press comprising the step of:

drawing a packing sleeve over a printing unit cylinder in an offset printing press, wherein the packing sleeve is recited in claim 1.

9. An offset printing press comprising:

a printing unit cylinder having a packing sleeve as recited in claim 1.

10. The packing sleeve as recited in claim 2 wherein the lines run parallel to an axis of the packing sleeve.

11. The packing sleeve as recited in claim 1 wherein the elasticity of the area is anisotropic.

12. The packing sleeve as recited in claim 1 wherein the slot is trapezoidal or prismatic.

13. The packing sleeve as recited in claim 1 wherein the incisions extend through the packing sleeve.

14. The packing sleeve as recited in claim 1 wherein the packing sleeve includes a number of segments that are welded together alternately discontinuously.

15. The packing sleeve as recited in claim 1 wherein the packing sleeve is made from metal.

16. The offset printing press recited in claim 9 further comprising a printing plate for mounting on the packing sleeve, wherein a width of the incisions is selected to reduce deformation during a printing mode of the printing plate mounted on the packing sleeve.

* * * * *